US009073712B2

(12) United States Patent
Kotaka

(10) Patent No.: US 9,073,712 B2
(45) Date of Patent: Jul. 7, 2015

(54) MEDIUM CASSETTE AND RECORDING APPARATUS

(71) Applicant: SEIKO EPSON CORPORATION, Tokyo (JP)

(72) Inventor: Toshikazu Kotaka, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/933,639

(22) Filed: Jul. 2, 2013

(65) Prior Publication Data

US 2014/0008860 A1 Jan. 9, 2014

(30) Foreign Application Priority Data

Jul. 4, 2012 (JP) ..... 2012-150351

(51) Int. Cl.

| | |
|---|---|
| ***B65H 5/22*** | (2006.01) |
| ***B65H 83/00*** | (2006.01) |
| ***B65H 85/00*** | (2006.01) |
| ***B65H 1/00*** | (2006.01) |

(52) U.S. Cl.

CPC ..... *B65H 1/00* (2013.01)
USPC ..... 271/3.14; 271/145; 271/162; 271/163

(58) Field of Classification Search

CPC ..... B65H 1/04; B65H 1/28; B65H 31/10; B65H 31/22; B65H 31/24; B65H 2405/10; B65H 2405/31; B65H 2405/3321; B65H 2405/3322
USPC ..... 271/3.14, 145, 163, 162, 207; 399/393, 399/405; 347/104
See application file for complete search history.

(56) References Cited

U.S. PATENT DOCUMENTS

| | | | | |
|---|---|---|---|---|
| 7,584,950 | B2 * | 9/2009 | Asada et al. | 271/9.07 |
| 7,618,035 | B2 * | 11/2009 | Koga et al. | 271/9.11 |
| 7,883,285 | B2 * | 2/2011 | Asada et al. | 400/624 |
| 2007/0182083 | A1 * | 8/2007 | Asada et al. | 271/9.01 |
| 2009/0085278 | A1 * | 4/2009 | Izuchi et al. | 271/145 |
| 2010/0078871 | A1 * | 4/2010 | Uchino et al. | 271/10.12 |
| 2012/0001378 | A1 * | 1/2012 | Izuchi et al. | 271/9.11 |
| 2012/0080833 | A1 | 4/2012 | Asada et al. | |
| 2012/0081489 | A1 | 4/2012 | Asada et al. | |
| 2013/0001850 | A1 * | 1/2013 | Okano et al. | 271/3.14 |
| 2013/0044174 | A1 * | 2/2013 | Takemura et al. | 347/108 |
| 2013/0221598 | A1 * | 8/2013 | Washino et al. | 271/3.14 |

FOREIGN PATENT DOCUMENTS

| | | |
|---|---|---|
| JP | 2012-076871 | 4/2012 |
| JP | 2012-076872 | 4/2012 |
| JP | 2012-076873 | 4/2012 |

* cited by examiner

*Primary Examiner* — David H Bollinger
(74) *Attorney, Agent, or Firm* — Workman Nydegger

(57) ABSTRACT

A recording apparatus includes a medium cassette provided with a medium accommodation tray that has a medium accommodation unit for accommodating a medium which is transported to a recording unit, and a paper discharge tray that is disposed on the upper side of the medium accommodation tray and that receives a medium on which recording has been performed at the recording unit. The paper discharge tray has a cutout formed from an end portion of the paper discharge tray which is on a feed-out side in a transport direction of the medium accommodation unit, and the cutout exposes the medium accommodation unit.

10 Claims, 8 Drawing Sheets

MEDIUM CASSETTE AND RECORDING APPARATUS

BACKGROUND

1. Technical Field

The present invention relates to medium cassettes that include medium accommodation trays for accommodating media and medium support trays for supporting media that are discharged after the media being recorded on, and also relates to recording apparatuses that are provided with the stated medium cassettes and are represented by facsimiles, printers, and so on.

2. Related Art

Paper cassettes that can be detachably mounted on main apparatus bodies have been widely used. Among those paper cassettes, as described in JP-A-2012-76871, a freely-detachable tray in which two paper accommodation units, that is, a lower-stage tray (main tray) and an upper-stage tray (second tray) are provided is well known. In addition, the tray described in JP-A-2012-76871 further includes a paper discharge tray. In other words, the tray described in JP-A-2012-76871 has a three-stage structure in which two paper accommodation trays and one paper discharge tray are stacked in a height direction thereof.

The tray described in JP-A-2012-76871 is configured in the following manner: that is, the second tray is provided in a slidable manner relative to the main tray; and when the second tray has slid to a predetermined position, the paper discharge tray is integrated with the second tray so that the paper discharge tray and the second tray can rotate together in an integrated manner.

However, since the paper discharge tray is disposed above a paper accommodation area of the second tray, there is a problem that operation of setting paper in the second tray is obstructed by the paper discharge tray, which makes it difficult to carry out the operation of paper setting.

SUMMARY

An advantage of some aspects of the invention is to make it easier to carry out the operation of setting paper in a medium cassette that are provided with a medium accommodation tray and a medium support tray.

Various names such as "cassette", "tray", and the like are given to a paper accommodation unit that accommodates paper in a recording apparatus. However, in this specification, a unit body that can be detachably mounted as one unit on a main apparatus body is referred to as a "cassette"; a paper accommodation unit for accommodating paper, a discharged paper receiving unit for supporting discharged paper, and the like that constitute the cassette are each referred to as a "tray".

A recording apparatus according to a first aspect of the invention includes a recording unit, a medium cassette provided with a medium accommodation tray that has a medium accommodation unit for accommodating a medium which is transported to the recording unit, and a paper discharge tray that is disposed on the upper side of the medium accommodation tray and that receives a medium on which recording has been performed at the recording unit. In the recording apparatus, the paper discharge tray has a cutout formed from an end portion of the paper discharge tray which is on a feed-out side in a transport direction of the medium accommodation unit, and the cutout exposes the medium accommodation unit.

According to this aspect, the paper discharge tray has a cutout that is formed from the end portion thereof which is on the feed-out side in the transport direction of the medium accommodation unit, and that exposes the medium accommodation unit. With this, the paper discharge tray does not obstruct the operation of setting a medium in the medium accommodation unit, or the degree of obstruction by the paper discharge tray can be alleviated in the operation, thereby making it easier to carry out the operation of setting a medium in the medium accommodation unit.

In a recording apparatus according to a second aspect of the invention, it is preferable for the cutout to expose the entire area of a medium accommodated in the medium accommodation unit.

According to this aspect, because the cutout exposes the entire area of a medium accommodated in the medium accommodation unit, operation of setting a medium in the medium accommodation unit is not obstructed by the paper discharge tray.

In a recording apparatus according to a third aspect of the invention, it is preferable for an edge guide that regulates the medium to be provided in the medium accommodation unit, and for the cutout to expose the edge guide.

According to this aspect, because the cutout exposes the edge guide, in the case where operation in which a medium is set in the medium accommodation unit and regulated by the edge guide is carried out, the operation is not obstructed by the paper discharge tray, or the degree of obstruction by the paper discharge tray can be alleviated.

In a recording apparatus according to a fourth aspect of the invention, it is preferable for the edge guide to be movable and for the cutout to expose the entire movement area of the edge guide.

According to this aspect, because the cutout exposes the entire movement area of the edge guide, in the case where operation in which a medium is set in the medium accommodation unit and the edge guide regulates the medium is carried out, the operation is not obstructed by the paper discharge tray.

In a recording apparatus according to a fifth aspect of the invention, it is preferable for the medium accommodation tray to include a first medium accommodation tray provided with a first medium accommodation unit for accommodating a medium and a second medium accommodation tray that is disposed on the upper side of the first medium accommodation tray and is provided with a second medium accommodation unit for accommodating a medium, and for the cutout of the paper discharge tray to expose the second medium accommodation unit of the second medium accommodation tray.

According to this aspect, in the case where operation in which a medium is set in the second medium accommodation unit of the second medium accommodation tray disposed above the first medium accommodation tray is carried out, the operation is not obstructed by the paper discharge tray, or the degree of obstruction by the paper discharge tray can be alleviated.

In a recording apparatus according to a sixth aspect of the invention, it is preferable for the size of a medium that is accommodated in the second medium accommodation unit is smaller than that of a medium that is accommodated in the first medium accommodation unit, and for the second medium accommodation tray to be movable both in a forward direction and in a backward direction relative to the paper discharge tray.

According to this aspect, it is possible to suppress the increase in size of the medium cassette; it is also possible to switch to/from the first medium accommodation unit from/to the second medium accommodation unit for the medium to be fed out by the movement of the second medium accommodation tray in the forward or backward direction.

In a recording apparatus according to a seventh aspect of the invention, it is preferable for the cutout of the paper discharge tray to expose the second medium accommodation unit of the second medium accommodation tray when the second medium accommodation tray has moved to a position at which the medium in the second medium accommodation unit can be fed out.

According to this aspect, it is easy to set a medium in the second medium accommodation unit when the second medium accommodation tray has moved to a position at which the medium in the second medium accommodation unit can be fed out.

In a recording apparatus according to an eighth aspect of the invention, it is preferable for the paper discharge tray to be rotatable so that the first medium accommodation unit of the first medium accommodation tray is exposed.

According to this aspect, it is also easy to set a medium in the first medium accommodation unit of the first medium accommodation tray.

In a recoding apparatus according to a ninth aspect of the invention, it is preferable for the second medium accommodation tray to be rotatable together with the paper discharge tray so that the first medium accommodation unit of the first medium accommodation tray is exposed.

According to this aspect, operation of setting a medium in the first medium accommodation unit of the first medium accommodation tray is not obstructed by the second medium accommodation tray.

A medium cassette according to a tenth aspect of the invention includes a medium accommodation tray provided with a medium accommodation unit for accommodating a medium that is transported to a recording unit, and a paper discharge tray that is disposed on the upper side of the medium accommodation tray and that receives a medium on which recording has been performed at the recording unit. In the medium cassette, the paper discharge tray has a cutout that is formed from an end portion of the paper discharge tray which is on the feed-out side in the transport direction of the medium accommodation unit, and that exposes the medium accommodation unit.

According to this aspect, the paper discharge tray has a cutout that is formed from the end portion thereof which is on the feed-out side in the transport direction of the medium accommodation unit, and that exposes the medium accommodation unit. With this, the paper discharge tray does not obstruct the operation of setting a medium in the medium accommodation unit, or the degree of obstruction by the paper discharge tray can be alleviated in the operation, thereby making it easier to carry out the operation of setting a medium in the medium accommodation unit.

A medium cassette according to an eleventh aspect of the invention includes a medium accommodation tray for accommodating a medium, and a medium support tray for supporting a medium that is disposed on the upper side of the medium accommodation tray and has a cutout formed at an end portion thereof on the upstream side in a medium discharge direction so as to expose at least part of a medium accommodation area of the medium accommodation tray.

According to this aspect, in the medium cassette including the medium accommodation tray and the medium support tray, a cutout that exposes at least part of the medium accommodation area of the medium accommodation tray is formed at the end portion of the medium support tray on the upstream side in the medium discharge direction. With this, operation of setting a medium in the medium accommodation tray which is disposed on the lower side of the medium support tray is not obstructed by the medium support tray, or the degree of obstruction by the medium support tray can be alleviated, thereby making it easier to carry out the operation of setting a medium in the medium accommodation tray.

A medium cassette according to a twelfth aspect of the invention includes a first medium accommodation tray for accommodating a medium, a second accommodation tray that is disposed on the upper side of the first accommodation tray and accommodates a medium, and a medium support tray for supporting a medium that is disposed on the upper side of the second accommodation tray and has a cutout formed at an end portion thereof on the upstream side in the medium discharge direction so as to expose at least part of a medium accommodation area of the second medium accommodation tray.

According to this aspect, in the medium cassette including the first medium accommodation tray, the second medium accommodation tray and the medium support tray, a cutout that exposes at least part of the medium accommodation area of the second medium accommodation tray is formed at the end portion of the medium support tray on the upstream side in the medium discharge direction. With this, operation of setting a medium in the second medium accommodation tray which is disposed on the lower side of the medium support tray is not obstructed by the medium support tray, or the degree of obstruction by the medium support tray can be alleviated, thereby making it easier to carry out the operation of setting a medium in the second medium accommodation tray.

According to a thirteenth aspect of the invention, it is preferable, in the first or second aspect, for the cutout to be formed sufficiently large so as to expose the entirety of the medium accommodation area in a direction intersecting with the medium feed-out direction.

According to this aspect, because the cutout formed in the medium support tray is made sufficiently large so as to expose the entirety of the medium accommodation area, which is present on the lower side of the medium support tray, in the direction intersecting with the medium feed-out direction, operation of setting a medium in the medium accommodation area on the lower side of the medium support tray can be carried out further efficiently.

According to a fourteenth aspect of the invention, it is preferable for a medium cassette, in any one of the first through third aspects, to make an end portion of the cutout on the downstream side in the medium discharge direction be arranged at a position which is shifted toward the upstream side in the medium discharge direction relative to a position at which the leading edge of a medium makes contact with the medium support tray when the medium is discharged.

According to this aspect, because the end portion of the cutout on the downstream side in the medium discharge direction is arranged at a position which is shifted toward the upstream side in the medium discharge direction relative to a position at which the leading edge of a medium makes contact with the medium support tray when the medium is discharged, it is possible to prevent the leading edge of the medium from being caught on the edge of the cutout when the medium is discharged.

According to a fifteenth aspect of the invention, it is preferable for a recording apparatus to include a recording unit configured to record on a medium and the medium cassette according to any one of the eleventh through fourteenth aspects of the invention.

According to this aspect, the recording apparatus can obtain the same effect as that in any one of the eleventh through fourteenth aspects of the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
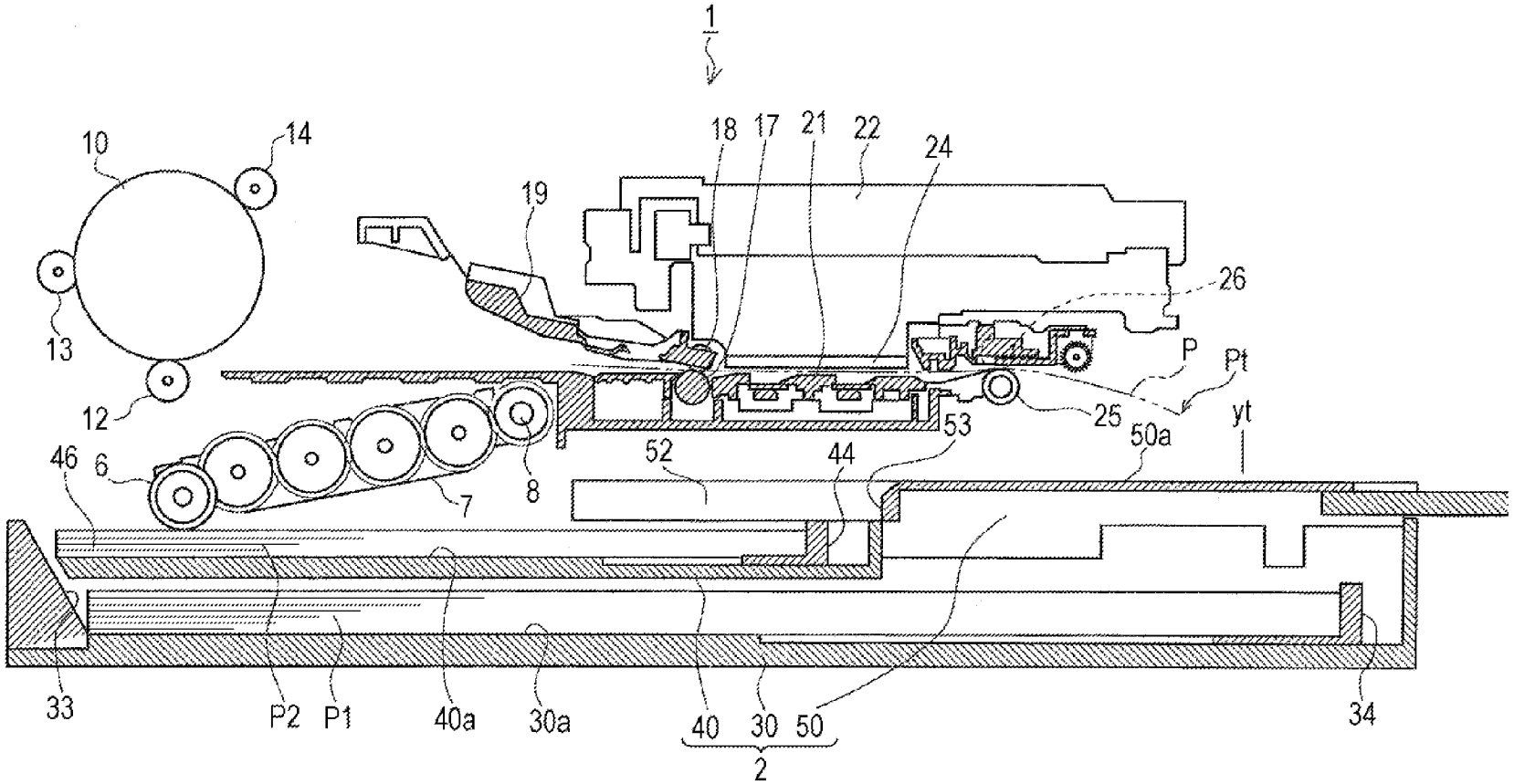
FIG. 1 is a side cross-sectional view illustrating a paper transport path in a printer according to an embodiment of the invention.
Figure 7:
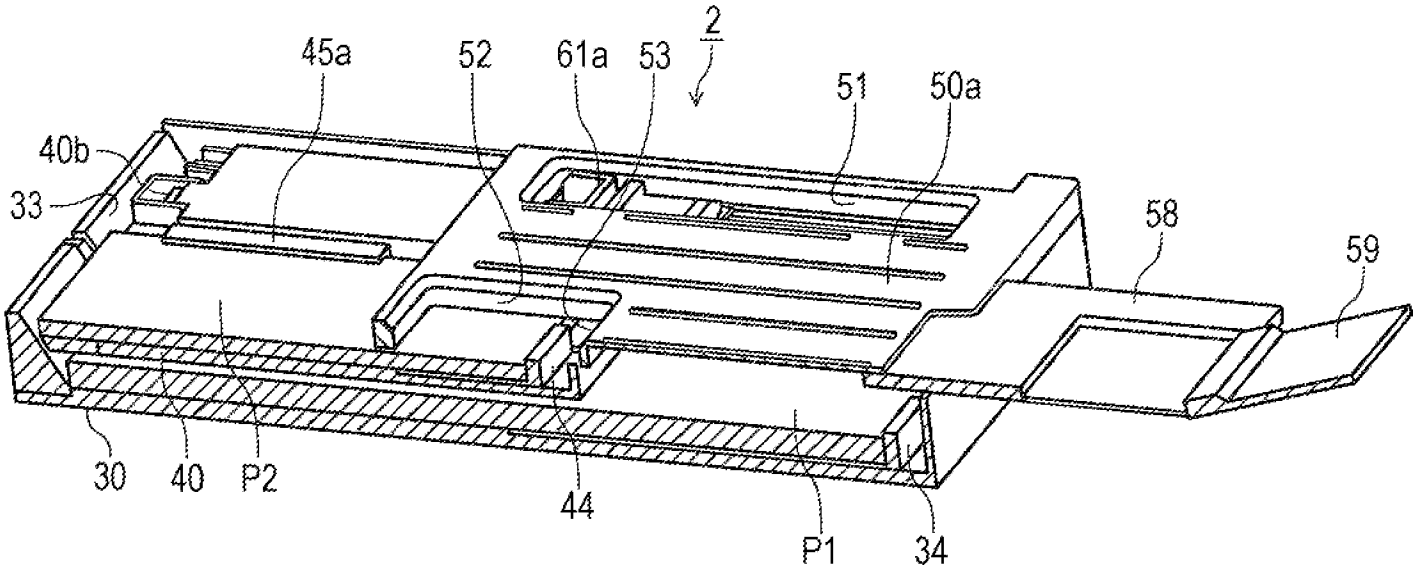
FIG. 7 is a cross-sectional perspective view of the paper cassette according to the embodiment of the invention.
Figure 8:
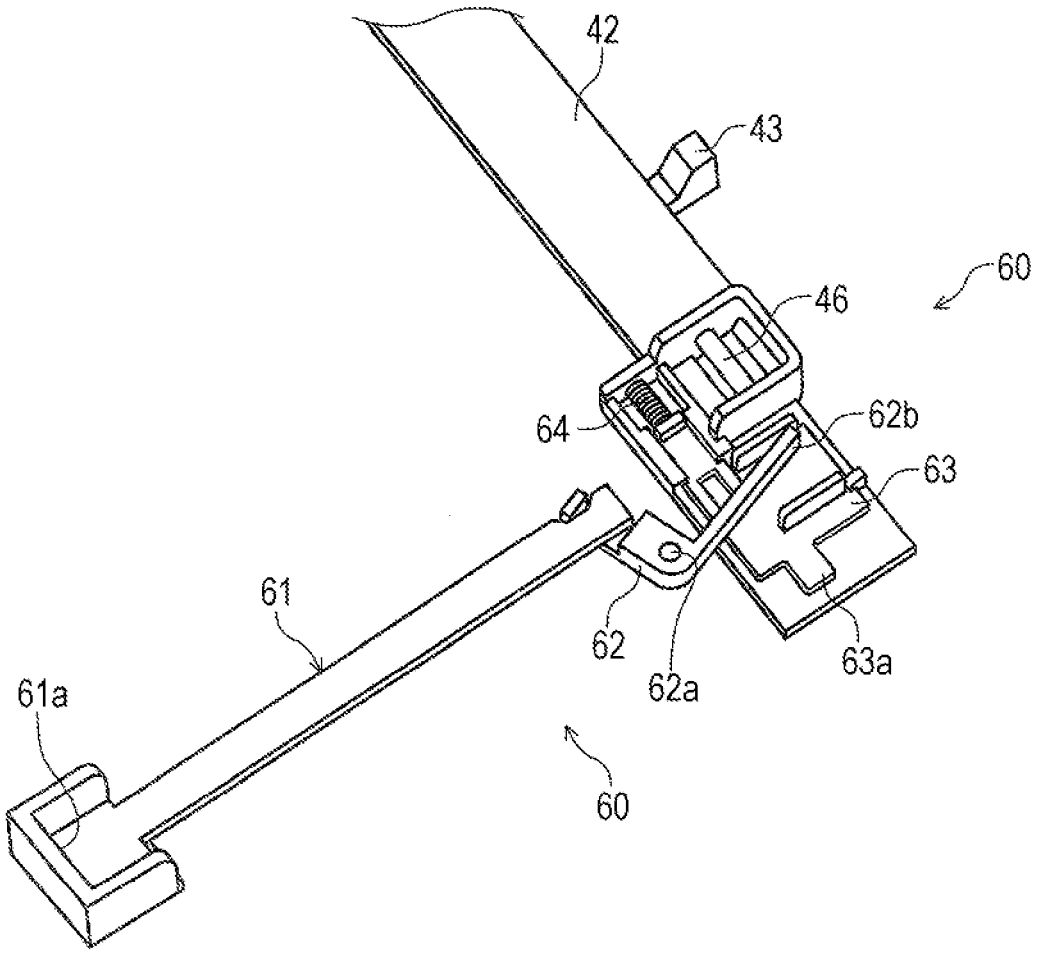
FIG. 8 is a perspective view of a lock mechanism.

Hereinafter, an embodiment of the invention will be described with reference to FIG. 1 through FIG. 8. FIG. 1 is a side cross-sectional view illustrating a paper transport path in an ink jet printer (hereinafter, referred to as a "printer") 1 as an embodiment of a "recording apparatus" according to the invention; FIGS. 2 through 6 are perspective views of a paper cassette 2 as an embodiment of a "medium cassette" according to the invention; FIGS. 2, 3, 5 and 6 illustrate a state in which an upper-stage tray 40 and a discharged paper receiving tray 50 are closed; and FIG. 4 illustrates a state in which the upper-stage tray 40 and the discharged paper receiving tray 50 are opened. FIG. 7 is a cross-sectional perspective view of the paper cassette 2; and FIG. 8 is a perspective view of a lock mechanism 60.

Figure 2:
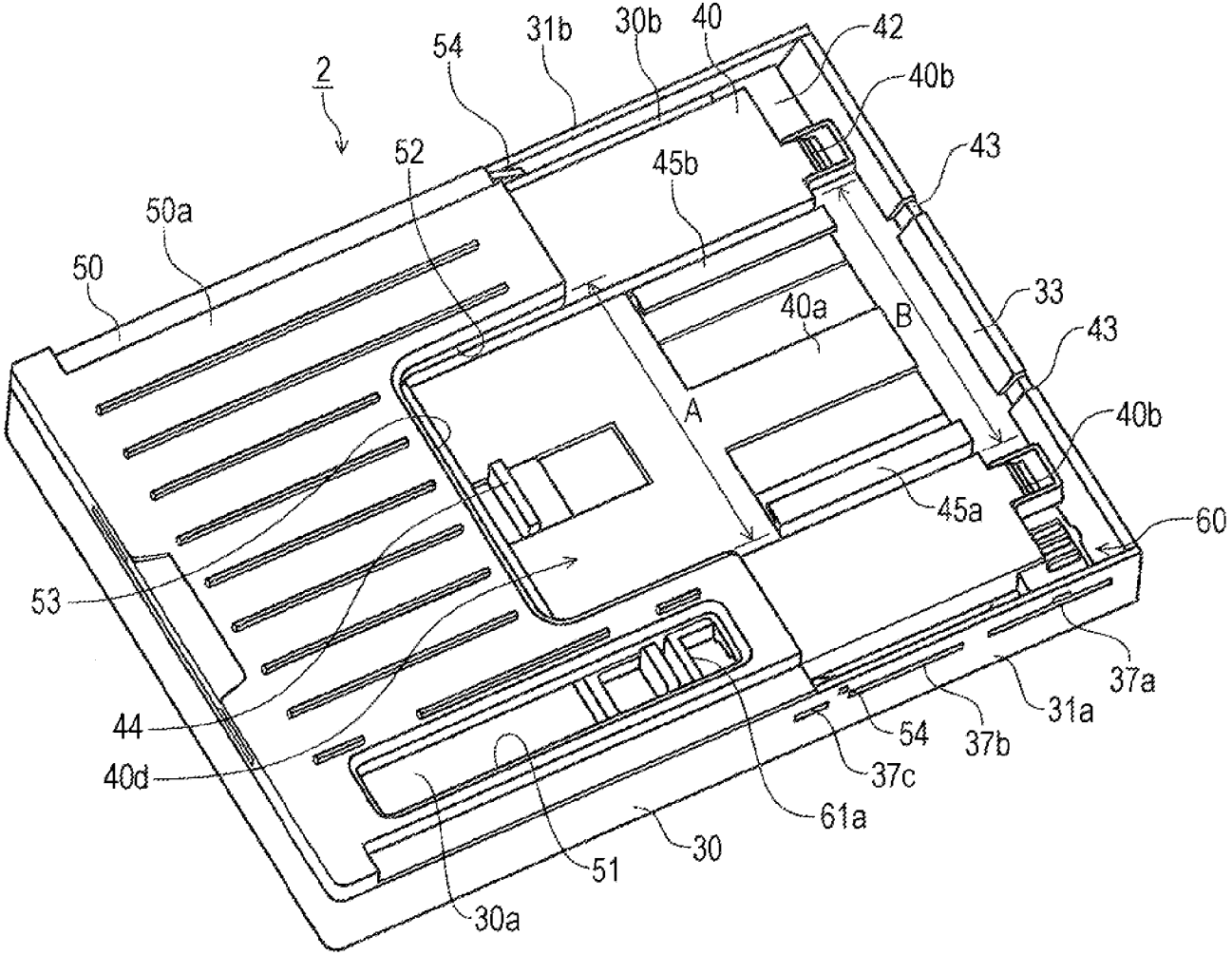
FIG. 2 is a perspective view of a paper cassette according to an embodiment of the invention.
Figure 3:
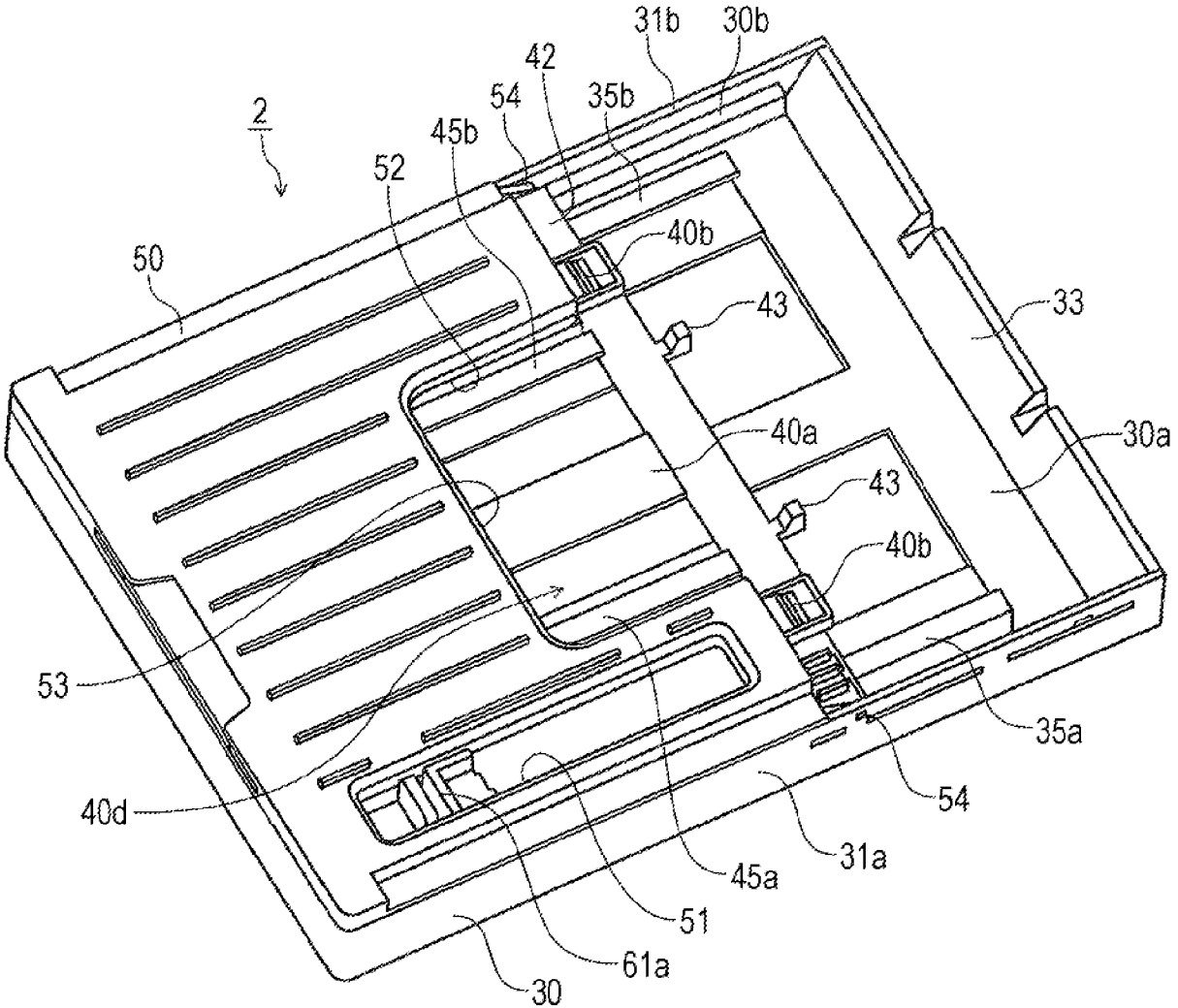
FIG. 3 is a perspective view of the paper cassette according to the embodiment of the invention.
Figure 4:
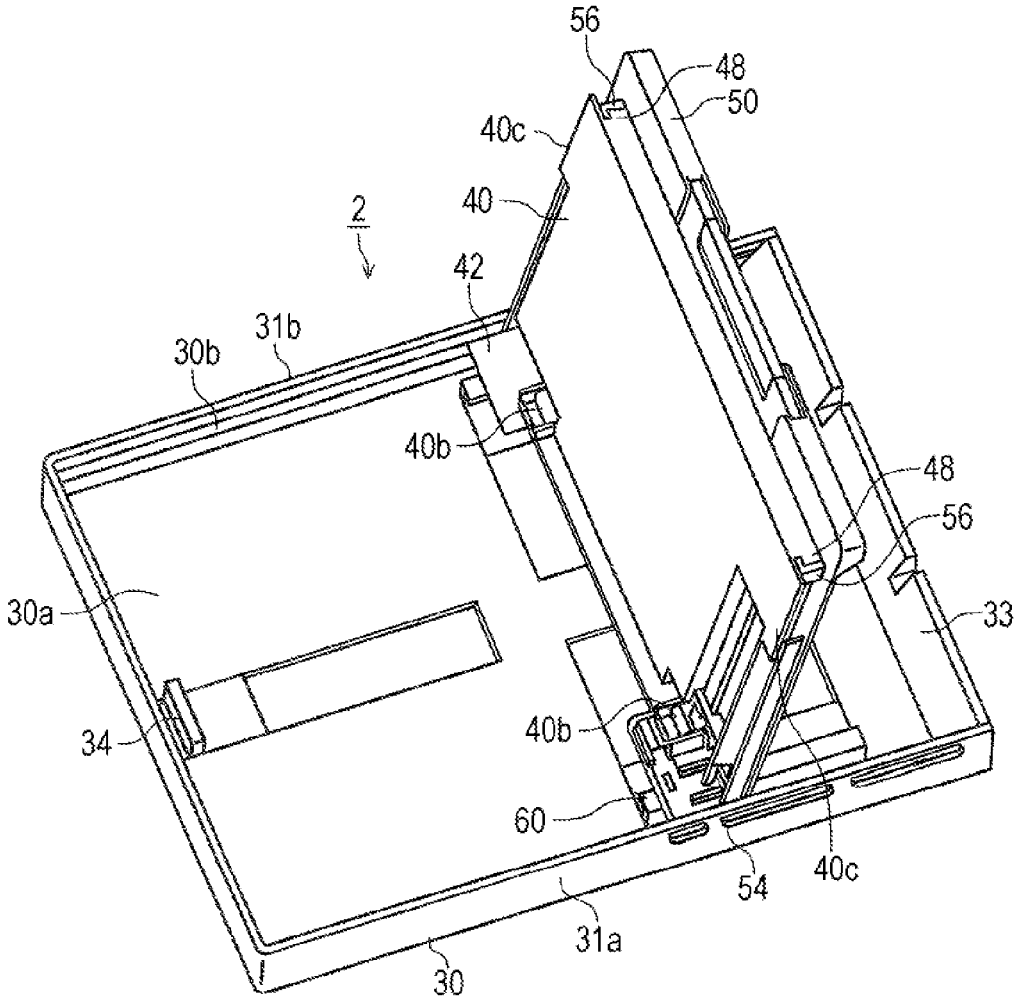
FIG. 4 is a perspective view of the paper cassette according to the embodiment of the invention.
Figure 5:
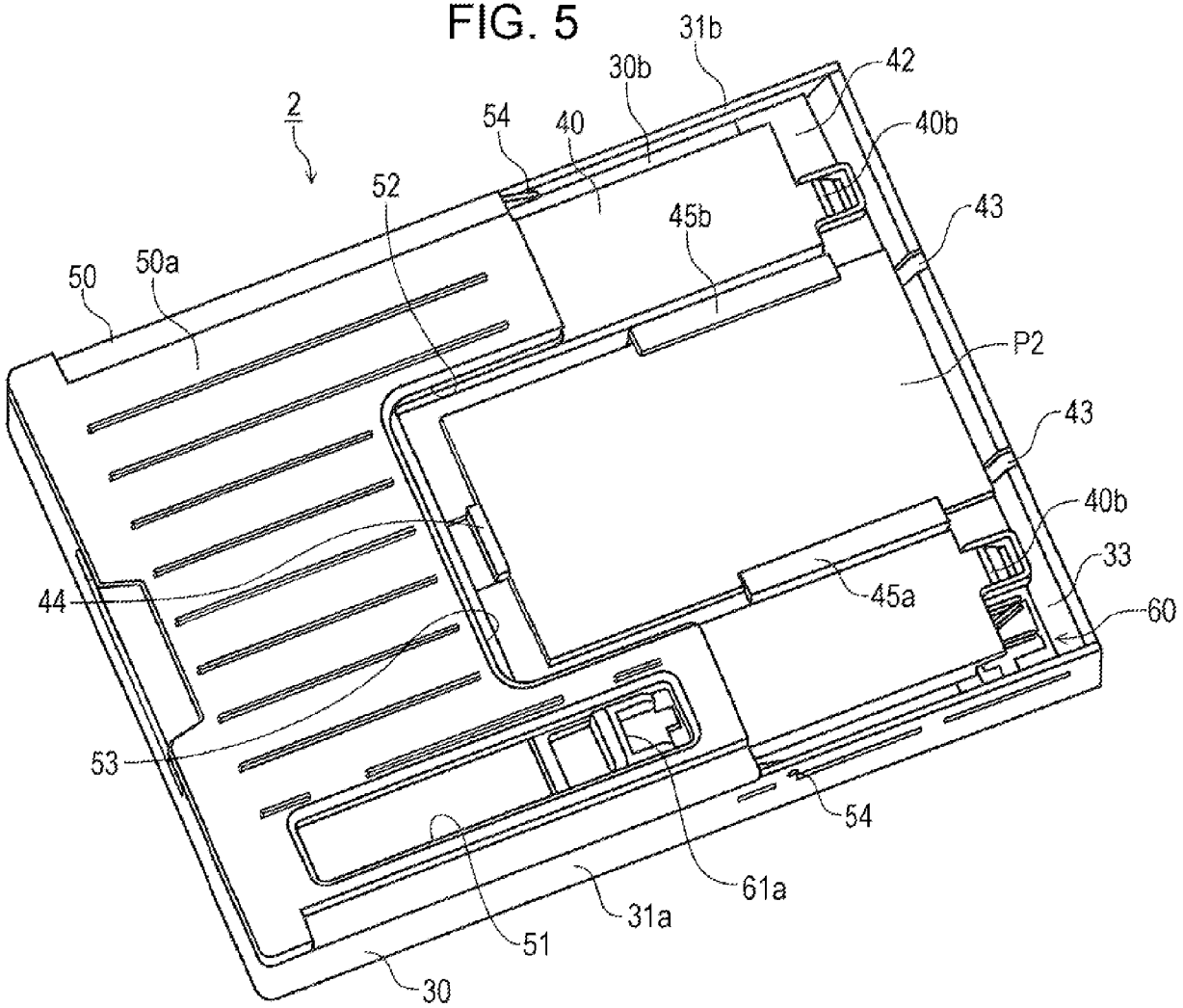
FIG. 5 is a perspective view of the paper cassette according to the embodiment of the invention.
Figure 6:
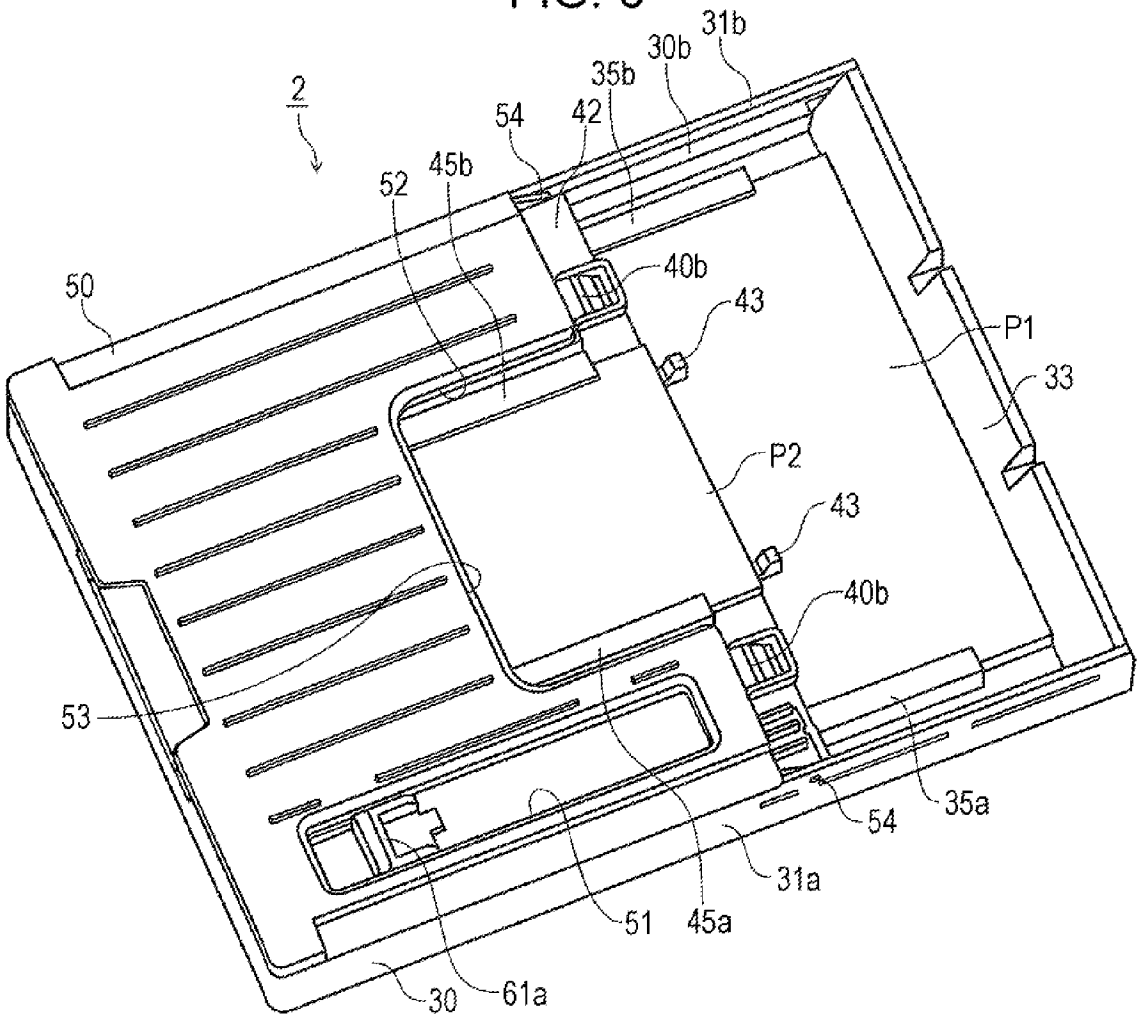
FIG. 6 is a perspective view of the paper cassette according to the embodiment of the invention.

FIGS. 2, 3 and 4 illustrate a state in which neither of the lower-stage tray 30 and the upper-stage tray 40 is accommodated with paper, whereas FIGS. 1, 5 and 6 illustrate a state in which both the lower-stage tray 30 and the upper-stage tray 40 are accommodated with paper.

In FIG. 1, the left direction is a paper feed-out direction (downstream side) and the front-back direction of the drawing is a paper-width direction. Further in FIG. 1, a point indicated by a reference numeral 46 is the center position of a shaft 46 (which is explained later).

Hereinafter, the overall configuration of the printer 1 will be described with reference to FIG. 1. The printer 1 has a configuration in which the paper cassette 2 is provided at the bottom of the apparatus, and paper as an example of a medium (mainly a single sheet) is fed out one by one from the paper cassette 2 so as to be recorded on by a recording head 24 and discharged toward the discharged paper receiving tray 50 provided at the front side of the apparatus (right side in FIG. 1).

More specifically, the paper cassette 2 in which a plurality of sheets of paper can be set in a laminated manner is provided with the following two medium accommodation trays: that is, one is the lower-stage tray 30 as a "first medium accommodation tray" that can be attached to and detached from the main apparatus body of the printer 1 from the front side of the apparatus, and is positioned lower of the two trays so as to constitute the base body of the paper cassette 2; the other is the upper-stage tray 40 as a "second medium accommodation tray" that is positioned on the upper side of the lower-stage tray 30 and is capable of sliding between a position from which the paper can be delivered and a retreat region thereof. Size of the medium accommodated in an accommodation unit of the second medium accommodation tray is smaller than that of the medium accommodated in an accommodation unit of the first medium accommodation tray.

The paper cassette 2 is further provided with the discharged paper receiving tray 50 as a "medium support tray" disposed on the upper side of the upper-stage tray 40. In other words, the paper cassette 2 according to the embodiment is a unit body in which the lower-stage tray 30, the upper-stage tray 40, and the discharged paper receiving tray 50 are integrally structured.

Note that in FIG. 1, paper accommodated in the lower-stage tray 30 is indicated by a symbol P1, and paper accommodated in the upper-stage tray 40 is indicated by a symbol P2 (hereinafter, both will be referred to as "paper P" unless it is particularly necessary to distinguish them).

Above the paper cassette 2, there is provided a pickup roller 6 rotationally driven by a motor (not shown). The pickup roller 6 is provided in a swing member 7 that swings about a swing shaft 8. In the case where the upper-stage tray 40 is in a state of having shifted to a maximum extent toward the front side of the apparatus (right side in FIG. 1: the detaching direction side of the paper cassette 2), that is, when the upper-stage tray 40 is in the retreat region, the pickup roller 6 makes contact with the uppermost sheet of paper P1 accommodated in the lower-stage tray 30 and rotates so as to feed out the above uppermost sheet of paper P1 from the lower-stage tray 30.

When the upper-stage tray 40 has shifted to a maximum extent toward the rear side of the apparatus (left side in FIG. 1: the attaching direction side of the paper cassette 2) so as to be at an abutting position (a state of FIGS. 1, 2 and 5), which is the position from which the upper-stage tray 40 can deliver the paper, the pickup roller 6 makes contact with the uppermost sheet of paper P2 accommodated in the upper-stage tray 40 and rotates so as to feed out the above uppermost sheet of paper P2 from the upper-stage tray 40.

A separation slope 33 is provided at the downstream side in the paper feed-out direction of the lower-stage tray 30; sheets of paper are separated from each other (duplicate paper delivery is prevented) because the leading edge of paper fed out from the lower-stage tray 30 advances sliding the separation slope 33.

In a state in which the upper-stage tray 40 is located at the paper-deliverable position thereof (state of FIGS. 1 and 5), because the separation slope 33 in the lower-stage tray 30 is so structured as to stick out to the leading edge side of the paper P2 further than a stopper 43 provided at the front side of the upper-stage tray 40, it is possible for the separation slope 33 to be used as a separation unit when the paper is fed out from the upper-stage tray 40.

Paper P having been fed out from the lower-stage tray 30 or the upper-stage tray 40 is curved and reversed by a drive roller 10 that is rotationally driven by a motor (not shown), and is delivered to a recording unit. Note that reference numerals 12, 13 and 14 indicate slave rollers that nip paper P against the drive roller 10. Paper P fed out from the paper cassette 2 usually advances to the recording unit through the slave rollers 13 and 14. The slave roller 12 functions in the case where recording has been performed on the surface of paper P and subsequently the paper P is fed in the backward direction to be reversed so that recording is performed on the rear surface of the paper P.

The paper P having been delivered to the recording unit is precisely delivered to a location under the recording head 24 by a transport drive roller 17 that is rotationally driven by a motor (not shown) and a transport slave roller 18 that rotates in a driven manner while making press-contact with the transport drive roller 17. A reference numeral 19 indicates an upper paper guide for supporting the transport slave roller 18.

The recording head 24 is provided on the bottom of a carriage 22, and the carriage 22 is driven by a drive motor (not shown) so as to move back and forth in a main scanning direction (front-back surface direction of the paper of FIG. 1). A lower paper guide 21 is provided at a position opposed to the recording head 24; the distance between the paper P and the recording head 24 is defined by the lower paper guide 21.

On the downstream side of the recording head 24, to discharge the paper P on which recording has been performed, there are provided a discharge drive roller 25 that is rotationally driven by a motor (not shown) and a discharge slave roller 26 that rotates in a driven manner while making press-contact with the discharge drive roller 25. Rotation of the discharge drive roller 25 makes the paper P on which recording has been performed by the recording head 24 be discharged to the discharged paper receiving tray 50.

An outline of the printer 1 has been described thus far; hereinafter, details of the paper cassette 2 will be given with reference to FIG. 2 and the subsequent figures.

The lower-stage tray 30 includes an edge guide 34 slidable in a paper delivery direction (in other words, lengthwise direction of paper) on a bottom surface 30*a* thereof (FIGS. 1 and 4); a rear edge position of the paper is regulated by the edge guide 34.

Further, edge guides 35*a* and 35*b* slidable in a direction orthogonal to the paper delivery direction (in other words, paper-width direction) are provided as well in the lower-stage tray 30 (FIGS. 3 and 6); side edge positions of the paper are regulated by the edge guides 35*a* and 35*b*.

Meanwhile, like the lower-stage tray 30, the upper-stage tray 40 includes an edge guide 44 slidable in the lengthwise direction of paper and edge guides 45*a* and 45*b* slidable in the paper-width direction on a bottom surface 40*a* thereof (FIGS. 1, 2, 5 and 6). Note that in this embodiment, the size of a paper accommodation area 40*d* of the upper-stage tray 40 is so set as to accommodate smaller paper in size in comparison with the lower-stage tray 30.

The edge guides 34 and 44 can be slid in the paper feed-out direction and can be held at the positions to which the guides have been slid. Further, the edge guides 35*a*, 35*b*, 45*a* and 45*b* can be slid along a direction orthogonal to the paper feed-out direction (in other words, paper-width direction) and can be held at the positions to which the guides have been slid.

Next, the movable structure of the upper-stage tray 40 will be described. Step portions 30*b* are formed on side walls 31*a* and 31*b* of the lower-stage tray 30 (in FIGS. 2 through 6, a step portion formed on the side wall 31*b* is indicated by a reference numeral 30*b*); the upper-stage tray 40 and a slider 40 are so arranged as to change the positions thereof by sliding along the step portions 30*b* on both the sides in the paper delivery direction and in the reverse direction thereof.

Two shafts 46 are provided in the slider 42 (see FIG. 8: note that only a shaft at one side is illustrated in FIG. 8); bearings 40*b* formed in the upper-stage tray 40 are fitted onto the shafts 46 of the slider 42, whereby the upper-stage tray 40 is attached in a freely rotatable manner with respect to the slider 42. In this embodiment, the shaft 46 onto which the bearing 40*b* is fitted has an axis line in a direction orthogonal to the paper delivery direction, therefore, the upper-stage tray 40 has a rotational axis line in a direction orthogonal to the paper delivery direction. Further, in this embodiment, a rotational movement limit of the upper-stage tray 40 (and the discharged paper receiving tray 50) is the state as illustrated in FIG. 4, that is, greater than 90 degrees and less than 180 degrees.

Support target portions 40*c* are formed at both ends of the upper-stage tray 40; the posture in a closed state of the upper-stage tray 40 is defined by the support target portions 40*c* being supported by the step portions 30*b* formed in the lower-stage tray 30. In addition, the upper-stage tray 40 changes its displacement in a sliding manner relative to the lower-stage tray 30 by the slider 42 and the support target portions 40*c* sliding on the step portions 30*b*.

The lock mechanism 60 makes it possible for the upper-stage tray 40 to be held at a predetermined slide position. A reference numeral 61*a* indicates a knob portion; in a state in which the knob portion 61*a* is not operated, the lock mechanism 60 holds the upper-stage tray 40 at a predetermined slide position. If a user holds the knob portion 61*a*, the above slide-position holding state is released and the upper-stage tray 40 and the slider 42 are made slidable.

FIG. 8 is a perspective view illustrating a structure of the lock mechanism 60. The lock mechanism 60 includes an operation arm 61, a lever 62, a slider 63, and a spring 64. The operation arm 61 is provided in a slidable manner along the paper feed-out direction in the upper-stage tray 40, and the lever 62 is so provided as to swing in the clockwise and counterclockwise directions in a plan view of the upper-stage tray 40 in the case where a bearing 62*a* is fitted onto a shaft (not shown) provided in the upper-stage tray 40.

The slider 63 is so provided as to slide on the slider 42 in a direction orthogonal to the paper feed-out direction, that is, in the paper-width direction. The lever 62 engages with the operation arm 61 and swings with sliding movement of the operation arm 61; moreover, the swing of the lever 62 causes an arm 62*b* included in the lever 62 to slide the slider 63.

A projection 63*a* is formed on the slider 63, and this projection 63*a* is so arranged as to be inserted into slots 37*a*, 37*b* and 37*c* formed on the side wall 31*a* of the lower-stage tray 30 (illustrated in FIG. 2). This makes it possible for the lock mechanism 60 to hold the upper-stage tray 40 in a predetermined region. In particular, in the case where the upper-stage tray 40 is placed at a position on the upstream side in the paper feed-out direction (FIGS. 3 and 6), the tray is held at that position by the lock mechanism 60. Further, the spring 64 biases the slider 63 so that the slider 63 is held in a state in which the projection 63*a* is inserted into any one of the slots 37*a*, 37*b* and 37*c* unless the operation arm 61 is operated.

Next, details of the discharged paper receiving tray 50 will be given below. The discharged paper receiving tray 50 of this embodiment includes a first sub-tray 58 and a second sub-tray 59 at the leading portion thereof in a paper discharge direction (FIG. 7). The first sub-tray 58 is so provided as to slide along the paper discharge direction relative to the main body of the discharged paper receiving tray 50. The first sub-tray 58 is extracted when in use as shown in FIG. 7; when not in use, it is pushed in so as to be stored in the main body of the discharged paper receiving tray 50. The second sub-tray 59 is so provided as to rotate with respect to the first sub-tray 58; the second sub-tray 59, when in use, takes an upwardly inclined posture as shown in FIG. 7 to hold the paper P to be discharged while preventing the paper P from sliding in the discharge direction and dropping.

A reference numeral 50*a* indicates a support surface that receives the paper. A window opening indicated by a reference numeral 51 is formed in the support surface 50*a*; the window opening 51 exposes the knob portion 61*a*.

The discharged paper receiving tray 50 as configured above is supported by the lower-stage tray 30. To be more specific, the discharged paper receiving tray 50 is supported by the side walls 31*a* and 31*b* of the lower-stage tray 30 in a closed state, whereby the posture in the closed state of the discharged paper receiving tray 50 is defined.

Rotational shafts 54 are formed at both sides of the discharged paper receiving tray 50, and pivotally supported by the side walls 31*a* and 31*b* of the lower-stage tray 30. In other words, the discharged paper receiving tray 50 is connected to the lower-stage tray 30 in a rotatable manner via the rotational shafts 54. In this embodiment, the positions at which the rotational shafts 54 are pivotally supported are slightly on the downstream side (paper delivery direction side) from the center in the paper delivery direction as shown in FIGS. 2 through 6. However, the positions for the pivotally supporting are not limited to the positions discussed above, and other positions may be appropriately set.

Further, the discharged paper receiving tray 50 engages with the upper-stage tray 40. To be more specific, as shown in FIG. 4, engaging portions 56 are formed at both sides on the downstream side in the paper discharge direction (upstream side in the paper delivery direction) of the discharged paper receiving tray 50, while in the upper-stage tray 40, there are formed engaging portions 48 to engage with the engaging portions 56.

When the upper-stage tray 40 is positioned at the upstream side in the paper delivery direction (a state illustrated in FIGS. 3 and 6), the engaging portions 56 formed in the discharged paper receiving tray 50 and the engaging portions 48 formed in the upper-stage tray 40 are engaged with each other as shown in FIG. 4, whereby the upper-stage tray 40 and the discharged paper receiving tray 50 are integrated. Consequently, it is possible to rotate the upper-stage tray 40 and the discharged paper receiving tray 50 in an integrated manner as is indicated by the change from FIG. 3 to FIG. 4 or from FIG. 4 to FIG. 3.

In the paper cassette 2 having the above-described configuration, a cutout 52 that exposes the paper accommodation area 40*d* of the upper-stage tray 40 is formed in a "U" shape when viewed from above at the end portion on the upstream side in the paper discharge direction of the discharged paper receiving tray 50. In the case where the upper-stage tray 40 is positioned at the downstream side in the paper feed-out direction, because the edge guide 44 is completely exposed by the cutout 52 as shown in FIG. 2 and the entirety of the slide area of the edge guide 44 is also exposed, the edge guide 44 can be operated with ease. It is to be noted that the end portion on the upstream side in the paper discharge direction of the discharged paper receiving tray 50 is also called the end portion on the feed-out side in the transport direction of the paper accommodation unit of the upper-stage tray 40.

Since the cutout 52 exposes the paper accommodation area 40*d* of the upper-stage tray 40, operation of setting paper in the upper-stage tray 40 which is positioned on the lower side of the discharged paper receiving tray 50 is not obstructed by the discharged paper receiving tray 50, thereby making it easier to carry out the operation of setting paper in the upper-stage tray 40.

In this embodiment, as shown in FIG. 2, dimension "A" of the cutout 52 in a direction orthogonal to the paper feed-out direction (that is, paper-width direction) is formed substantially equal to dimension "B" of the paper accommodation area 40*d* of the upper-stage tray 40 in the paper-width direction. In other words, the cutout 52 is formed sufficiently large so as to expose the entirety in the paper-width direction of the paper accommodation area 40*d*. This makes it easier to carry out the operation of setting paper in the upper-stage tray 40.

Moreover in this embodiment, in the case where the upper-stage tray 40 is positioned at the downstream side in the paper feed-out direction, the cutout 52 exposes not only the entirety in the paper-width direction but also the entirety in the paper feed-out direction of the paper accommodation area 40*d* of the upper-stage tray 40. In other words, the cutout 52 of this embodiment exposes the entirety of the paper accommodation area 40*d*. This makes it extremely easy to carry out the operation of setting paper in the upper-stage tray 40 in this embodiment. In addition, the edge guides 44, 45*a* and 45*b* can also be operated with ease.

Further in this embodiment, as is obviously indicated in FIG. 1, because an end portion of the cutout 52 on the downstream side in the paper discharge direction (indicated by a reference numeral 53 in FIGS. 1, 2, 3, 5 and 6) is provided at a position which is shifted toward the upstream side in the paper discharge direction (left side in FIG. 1) relative to a position at which a leading edge Pt of paper P makes contact with the discharged paper receiving tray 50 (substantially a position yt in FIG. 1) when the paper P is discharged, it is possible to prevent the leading edge Pt of the paper P from being caught on an edge 53 of the cutout 52 when the paper P is discharged.

Note that the above-described embodiment is an example of the invention, and it is needless to say that the invention is not limited to the above-described embodiment. For example, in the above embodiment, the paper cassette 2 includes two paper accommodation trays (the lower-stage tray 30 and upper-stage tray 40) and one discharged paper receiving tray 50; however, the number of the paper accommodation trays may be one or more than two. That is, in the configuration that includes a discharged paper receiving tray and a paper accommodation tray disposed on the lower side of the discharged paper receiving tray, it is sufficient that a cutout which exposes at least part of a paper accommodation area of the paper accommodation tray is formed in the discharged paper receiving tray.

Although the cutout 52 of the embodiment is formed sufficiently large so as to expose the entirety in the paper-width direction of the paper accommodation area 40*d* of the upper-stage tray 40, the invention is not limited thereto; and the cutout 52 may be formed so as to expose at least part of the paper accommodation area 40*d* in the paper-width direction.

The entire disclosure of Japanese Patent Application No. 2012-150351, filed Jul. 4, 2012 is expressly incorporated by reference herein.

What is claimed is:

1. A recording apparatus comprising:

a recording unit;

a medium cassette having a first medium accommodation tray configured to accommodate a first medium which is transported to the recording unit and a second medium accommodation tray disposed on an upper side of the first medium accommodation tray and configured to accommodate a second medium which is transported to the recording unit; and a paper discharge tray that is disposed above an upper side of the first medium accommodation tray and that receives the first medium and the second medium on which recording has been performed at the recording unit, wherein the paper discharge tray has a cutout formed from an end portion of the paper discharge tray which is on a feed-out side in a transport direction of the medium cassette, the cutout having an open end at the end portion and the second medium accommodation tray sliding in the transport direction relative to the end portion and the paper discharge tray, and the cutout exposes one of the first medium accommodation tray and the second medium accommodation tray.

2. The recording apparatus according to claim 1, wherein the cutout exposes an entire area of the second medium accommodated in the second medium accommodation tray.

3. The recording apparatus according to claim 2, wherein an edge guide that regulates the second medium is provided in the second medium accommodation tray, and the cutout exposes the edge guide.

4. The recording apparatus according to claim 3, wherein the edge guide is movable, and the cutout exposes an entire movement area of the edge guide.

5. The recording apparatus according to claim 1, wherein the cutout of the paper discharge tray exposes of the second medium accommodation tray.

6. The recording apparatus according to claim 5, wherein size of the second medium that is accommodated in the second medium accommodation tray is smaller than that of the first medium that is accommodated in the first medium accommodation tray, and the second medium accommodation tray is capable of advancing and retreating relative to the paper discharge tray.

7. The recording apparatus according to claim 6, wherein the cutout of the paper discharge tray exposes the second medium accommodation tray when the second medium accommodation tray has moved to a position at which the second medium in the second medium accommodation tray can be fed out.

8. The recording apparatus according to claim 7, wherein the paper discharge tray is rotatable so that the first medium accommodation tray is exposed.

9. The recoding apparatus according to claim 8, wherein the second medium accommodation tray is rotatable together with the paper discharge tray so that the first medium accommodation tray is exposed.

10. A medium cassette comprising:

a first medium accommodation tray accommodating a first medium that is transported to a recording unit;

a second medium accommodation tray accommodating a second medium that is transported to the recording unit; and a paper discharge tray that is disposed on the upper side of the first medium accommodation tray and that receives the first medium and the second medium on which recording has been performed at the recording unit, wherein the paper discharge tray has a cutout that is formed from an end portion of the paper discharge tray which is on the feed-out side in the transport direction of the first medium accommodation tray and the second medium accommodation tray, the cutout having an open end at the end portion and the second medium accommodation tray sliding in the transport direction relative to the end portion and the paper discharge tray, and the cutout exposes one of the first medium accommodation tray and the second medium accommodation tray.

* * * * *